US006284045B1

(12) United States Patent
Nakamura et al.

(10) Patent No.: US 6,284,045 B1
(45) Date of Patent: Sep. 4, 2001

(54) APPARATUS FOR BUILDING UNBURNED REFRACTORY

(75) Inventors: Ryosuke Nakamura; Toshihiko Kaneshige; Seiji Nagai; Keizo Nishimura, all of Chiyoda-ku (JP)

(73) Assignee: Shinagawa Refractories Co., Ltd., Tokyo (JP)

( * ) Notice: Subject to any disclaimer, the term of this patent is extended or adjusted under 35 U.S.C. 154(b) by 0 days.

(21) Appl. No.: 09/355,132

(22) PCT Filed: Nov. 19, 1998

(86) PCT No.: PCT/JP98/05220

§ 371 Date: Jul. 23, 1999

§ 102(e) Date: Jul. 23, 1999

(87) PCT Pub. No.: WO99/26746

PCT Pub. Date: Jun. 3, 1999

(30) Foreign Application Priority Data

Nov. 25, 1997 (JP) ..... 9-322978

(51) Int. Cl.[7] ..... B05B 13/06

(52) U.S. Cl. ..... 118/306; 118/300; 118/305; 148/668; 148/669; 148/670; 148/671

(58) Field of Search ..... 118/300, 305, 118/306; 148/668, 669, 670, 671

(56) References Cited

FOREIGN PATENT DOCUMENTS

| | | | |
|---|---|---|---|
| S52-7818 | | 1/1977 | (JP) . |
| S59-70461 | | 4/1984 | (JP) . |
| S63-154258 | | 6/1988 | (JP) . |
| H1-31340 U | | 9/1989 | (JP) . |
| H4-7176 U | | 2/1992 | (JP) . |
| 6-145742 | * | 5/1994 | (JP) . |
| H6-48139 | | 6/1994 | (JP) . |
| H6-69697 U | | 9/1994 | (JP) . |
| H8-25023 | | 1/1996 | (JP) . |
| 8-188809 | * | 7/1996 | (JP) . |

* cited by examiner

*Primary Examiner*—Richard Crispino
*Assistant Examiner*—Yewebdar T Tadesse
(74) *Attorney, Agent, or Firm*—Koda & Androlia

(57) ABSTRACT

A monolithic refractory depositing system capable of improving working environment and working efficiency and of spraying a material in a uniform thickness is provided. The monolithic refractory depositing system is capable of carrying out both a spraying process and a casting process. The monolithic refractory depositing system comprises a carriage (4) placed on rails (2) laid near a molten metal container (ladle) (1) so as to travel along the rails (2), a truck (7) capable of moving in directions perpendicular to the moving directions of the carriage (4), a post (8) set up on the traverse truck (7), an elevating frame (10) mounted for vertical movement on the traverse truck (7), a material feed pipe (9) inserted in an upper part of the elevating frame (10) and a spray nozzle (27) (or a pouring pipe (39)) detachably connected to a lower end of the material feed pipe (9), and a bendable support means (20) capable of moving together with the elevating frame (10) and connected to a part of the material feed pipe (9) on an upper side of the elevating frame (10).

15 Claims, 14 Drawing Sheets

APPARATUS FOR BUILDING UNBURNED REFRACTORY

TECHNICAL FIELD

The present invention relates to a monolithic refractory depositing system for repairing a molten metal container, such as a ladle used in a steelworks or the like, or constructing a new molten metal container.

BACKGROUND ART

Conventional monolithic refractory depositing methods for repairing a molten metal container, such as a ladle, or constructing a new molten metal container are classified into spraying methods and casting methods.

Repairing methods using spraying are classified into dry spraying methods and wet spraying methods. A dry spraying method conveys refractory powder to a spraying nozzle by the agency of compressed air, mixes water or binder into the refractory powder in the spraying nozzle to produce refractory slurry, and sprays the refractory slurry by the agency of compressed air. A wet spraying method mixes refractory powder and water to produce a refractory mixture, kneads the refractory mixture to produce refractory slurry, sends the refractory slurry through a spraying pipe by a pump, adds a binder to the refractory slurry in a spraying nozzle, and sprays the mixture of the refractory slurry and the binder by the agency of compressed air onto a desired surface.

A casting method, differing from the spraying method, assembles a form at the site, pours refractory slurry prepared by kneading a mixture of water and a refractory material into the form. Although a refractory structure constructed by a casting method has a dense texture and a long life, the construction of such a refractory structure needs a form inevitably.

Recently, there is a trend to use a wet spraying method capable of forming a high-quality refractory structure having durability comparable to that of a refractory structure formed by a casting method, and satisfactory in homogeneity.

The spraying method is carried out by hand spraying work (manual spraying work requiring an operator to hold and operate a nozzle by hand) or mechanical spraying work using a nozzle driving device. When carrying out the spraying method by hand spraying work, the operator needs to move the heavy nozzle by human power, which requires heavy manual work. Furthermore, the spraying method employing hand spraying has drawbacks that the operator working at the site is exposed to injurious rebound loss and dust, and different operators places the material in different thicknesses.

Although dry nozzle driving devices of various types for driving a spray nozzle have been developed for the dry spraying method, any wet nozzle driving device for driving a spray nozzle, suitable for the wet spraying method has not been developed yet.

As mentioned above, the casting method assembles a form at the site, and pours refractory slurry into the form by a belt conveyor or a chute. Recently, a pump capable of forcibly pumping a highly viscous material has been developed. Most recent casting methods convey a material through hoses by force feed to a casting place.

However, the casting method also needs inefficient, heavy manual work to carry a heavy nozzle to the casting place.

Incidentally, the employment of either the spraying method or the casting method is suitable for some repairing work or construction work, and the employment of both the spraying method and the casting methods is suitable for other repair work or construction work. So far, any construction system capable of executing both the spraying method and the casting method has not been developed. Therefore, when construction work needs to carry out both the spraying method and the casting method, both construction apparatuses for carrying out the spraying method and the casting method must be kept at the site and the construction apparatuses must be changed and necessary one of the construction apparatuses must be installed in place. Work for changing the construction apparatuses takes much time, equipment cost increases because a plurality of construction apparatuses are necessary, and increased maintenance work is necessary for the maintenance of the plurality of construction apparatuses.

DISCLOSURE OF THE INVENTION

Accordingly, it is an object of the present invention to provide a monolithic refractory depositing system capable of solving problems in the prior art, of improving working environment, of improving the efficiency of work and of spraying a material so as to form a homogeneous structure in a uniform thickness.

The monolithic refractory depositing system is capable of carrying out both a spraying method and a casting method.

A monolithic refractory depositing system according to the present invention comprises: a carriage placed on rails laid near a molten metal container so as to travel over the molten metal contain along the rails; a truck mounted on the carriage so as to move in directions perpendicular to the moving directions of the carriage; an elevating frame mounted for vertical movement on the elevating frame; a material feed pipe attached to the elevating frame; and a spray nozzle or a pouring pipe to be detachably connected to a lower end of the material feed pipe.

The truck may be a traverse truck mounted on the carriage so as to move in directions perpendicular to the moving directions of the carriage.

The truck may be tiltable relative to the carriage.

A post may be set up on the truck, and the elevating frame may be supported for vertical movement on the post.

A bendable support means capable of moving together with the elevating frame may be connected to a part of the material feed pipe on an upper side of the elevating frame.

The bendable support means may comprise pipes and a rotary joint joining the pipes together for turning relative to each other.

The monolithic refractory depositing system may be provided with a controller for the automatic control of spraying rate at which a material is sprayed, thickness in which the material is to be deposited and a spraying process according to the shape and size of the molten metal container.

The monolithic refractory depositing system may further comprise a support rod capable of turning and vertically moving along the material feed pipe and disposed in a vertical position, and a thickness measuring device held on a lower end part of the support rod to measure the thickness of a part of a structure being formed.

The material feed pipe may be inserted in an upper part of the elevating frame so as to project from a lower part of the elevating frame and supported on the elevating frame.

The monolithic refractory depositing system may be provided with an extendible mechanism, and the extendible mechanism may be attached to an upper part of the truck to move the elevating frame vertically.

The extendible mechanism may be attached to the truck so as to extend downward from an upper part of the truck.

The extendible mechanism may be a linkage of a pantograph type.

The material feed pipe may be connected to a material feed hose for feeding a material.

The material feed hose may be supported on a hose guide.

The pouring pipe may be turnable about a vertical axis.

The monolithic refractory depositing system may further comprise a pouring traverse truck disposed beside the truck and capable of moving in directions perpendicular to the moving directions of the carriage, a second material feed pipe may be connected to an upper part of the pouring traverse truck, and a second pouring pipe may be disposed on a lower part of the pouring traverse truck so as to be turnable in a horizontal plane.

BEST MODE FOR CARRYING OUT THE INVENTION

Preferred embodiments of the present invention will be described hereinafter with reference to the accompanying drawings.

First, a first embodiment of the present invention will be described.

Figure 1:
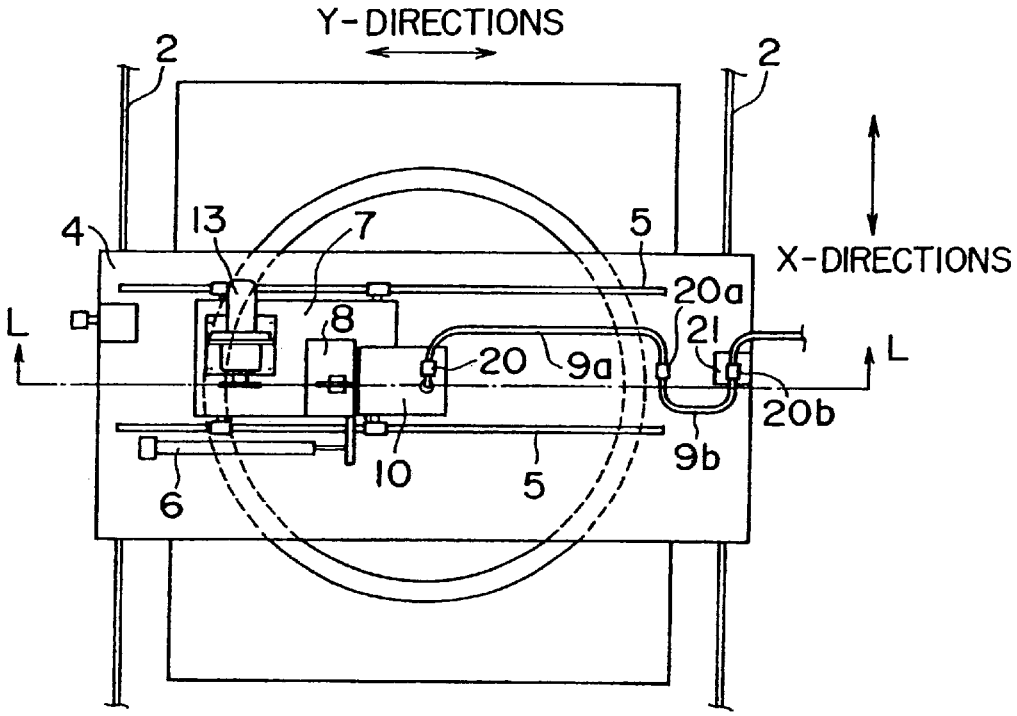
FIG. 1 is a plan view of a monolithic refractory depositing system in a first embodiment according to the present invention.
Figure 2:
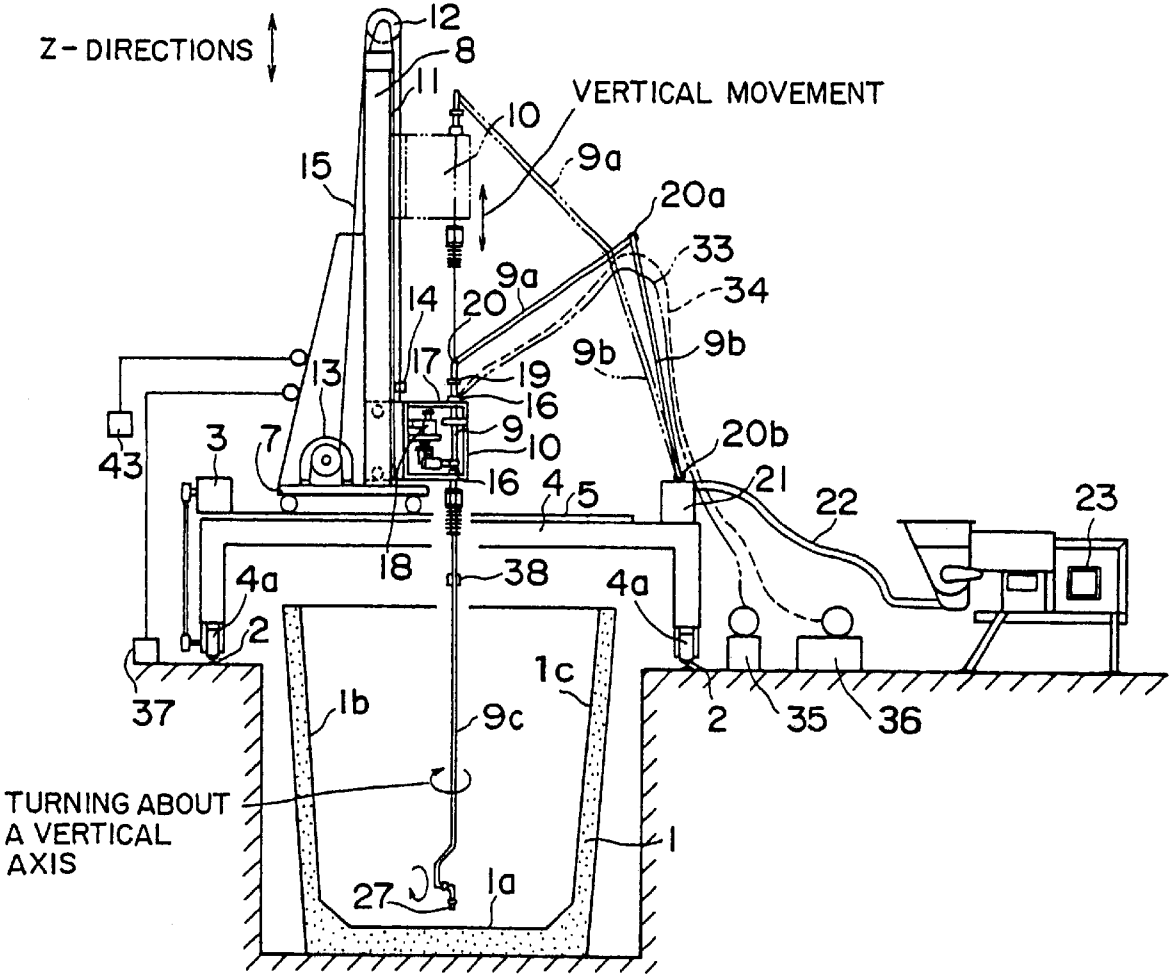
FIG. 2 is a sectional elevation taken online L-L in FIG. 1.

FIG. 1 is a plan view of a monolithic refractory depositing system in a first embodiment according to the present invention, and FIG. 2 is a sectional elevation taken online L—L in FIG. 1. As shown in FIG. 1 or 2, right and left rails 2 is laid near the upper end of a pit in which a lade 1 to be repaired is placed.

A gantry-type carriage 4 spanning the ladle 1 and placed on the rails 2. Wheels 4*a* included in the carriage 4 is driven for rotation by a motor 3 mounted on the carriage 4 to move the carriage 4 along the rails 2.

The monolithic refractory depositing system in the first embodiment comprises the carriage 4 capable of traveling along rails 2 extended near the ladle 1, a stationary or movable truck mounted on the carriage 4, a post set up on the truck, an elevating frame mounted for vertical movement on the post, a material feed pipe inserted in an upper part of the elevating frame to receive a spraying material forced into the material feed pipe by a pump for the force feed of the spraying material, a spray nozzle or a pouring pipe to be detachably connected to a lower end part of the material feed pipe projecting from a lower part of the elevating frame, and a bendable support means capable of vertically moving together with the elevating frame and supported on a part of the material feed pipe on an upper side of the elevating frame. More specifically, the monolithic refractory depositing system comprises the following components designated by reference characters.

A pair of guide rails 5 are fixedly laid on the carriage 4. A traverse truck 7 is driven for movement along the guide rail 5 in directions perpendicular to the traveling directions of the carriage 4 by an electric cylinder actuator 6.

A post 8 is set up on the traverse truck. An elevating frame 10 is guided for vertical movement by a vertical guide 11 on one side of the post 8. The elevating frame 10 is provided with a turning mechanism. A spraying material feed pipe 9 is extended vertically through and supported for rotation on the elevating frame 10. The spraying material feed pipe 9 is turned about a vertical axis.

A sheave 12 is supported on an upper part of the post 8. An electric winch 13 is mounted on the traverse truck 7. A hook 14 connected to an upper part of the elevating frame 10 is connected to the electric winch 13 by a wire 15 extended via the sheave 12. The elevating frame 10 is moved vertically along the vertical guide 11 through the wire 15 by the electric winch 13.

Figure 3A:
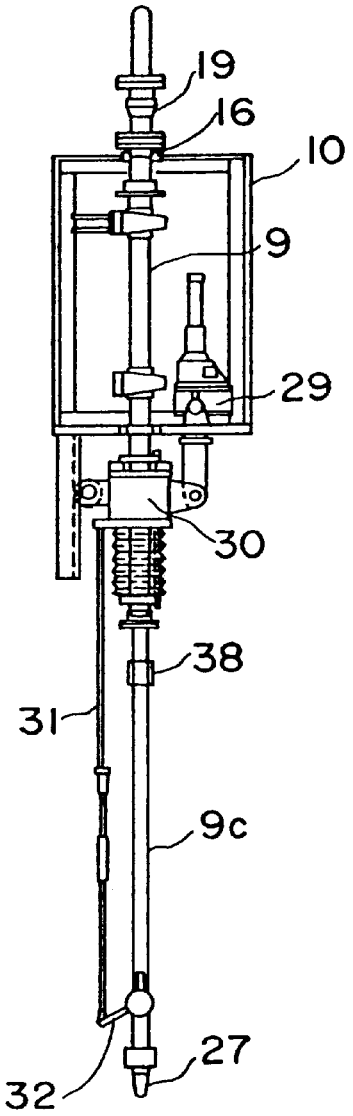
FIGS. 3A and 3B are a side elevation and a plan view, respectively, of an elevating frame shown in FIG. 2.
Figure 3B:
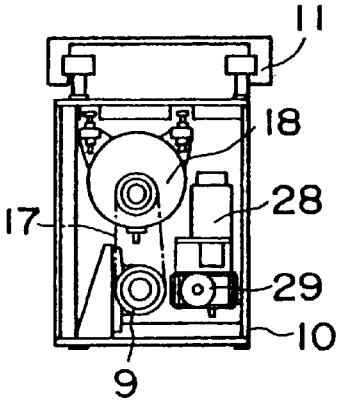

Referring to FIGS. 3A and 3B showing the material feed pipe 9 in a side elevation and a plan view, respectively, the material feed pipe 9 is supported in a bearing 16 fixed to an upper part of the elevating frame 10. A sprocket is put on the material feed pipe 9, and the material feed pipe 9 is driven for rotation through a chain 17 wound round the sprocket by a motor 18.

A sliding joint 19 is connected to an upper end part of the material feed pipe 9 projecting upward from the upper end of the elevating frame 10. Another material feed pipe 9*a* has one end connected to one end of the sliding joint 19 by a swivel pipe joint 20, i.e., a bendable support means, and the other end connected to one end of a third material feed pipe 9*b* by a swivel pipe joint 20*a*. The other end of the material feed pipe 9*b* is connected to a junction box 21 by a swivel pipe joint 20*b*. The junction box 21 is connected to a material supply device 23 by a material feed hose 22. The swivel pipe joints 20, 20*a* and 20*b* are bendable support means. The bendable support means enables the material feed pipes 9*a* and 9*b* to move according to the vertical movement of the elevating frame 10 to feed the spraying material smoothly to a spray nozzle 27.

The bendable support means may comprise rubber joints, flexible joints, bendable joints or bellows pipe joints instead of the swivel pipe joints.

Figure 4:
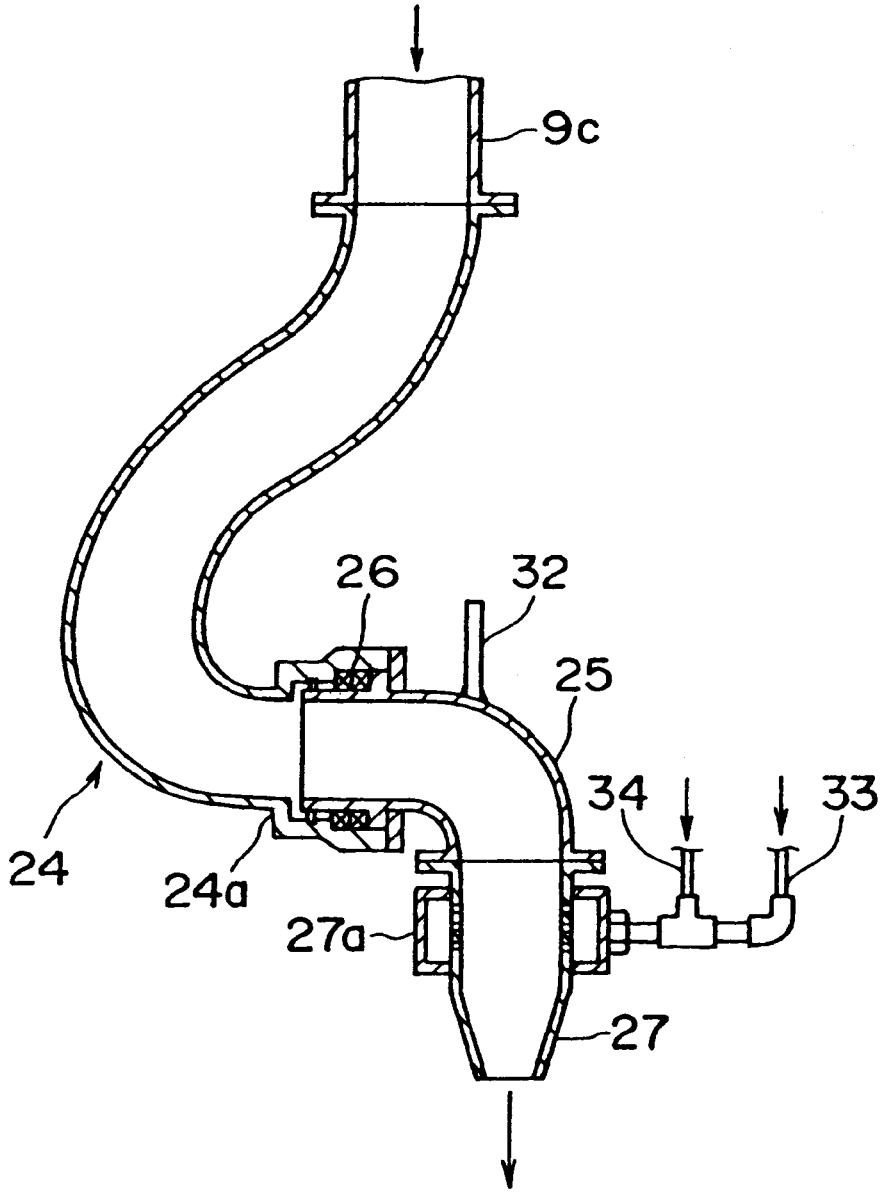
FIG. 4 is a sectional view of a spraying nozzle shown in FIG. 1.
Figure 5:
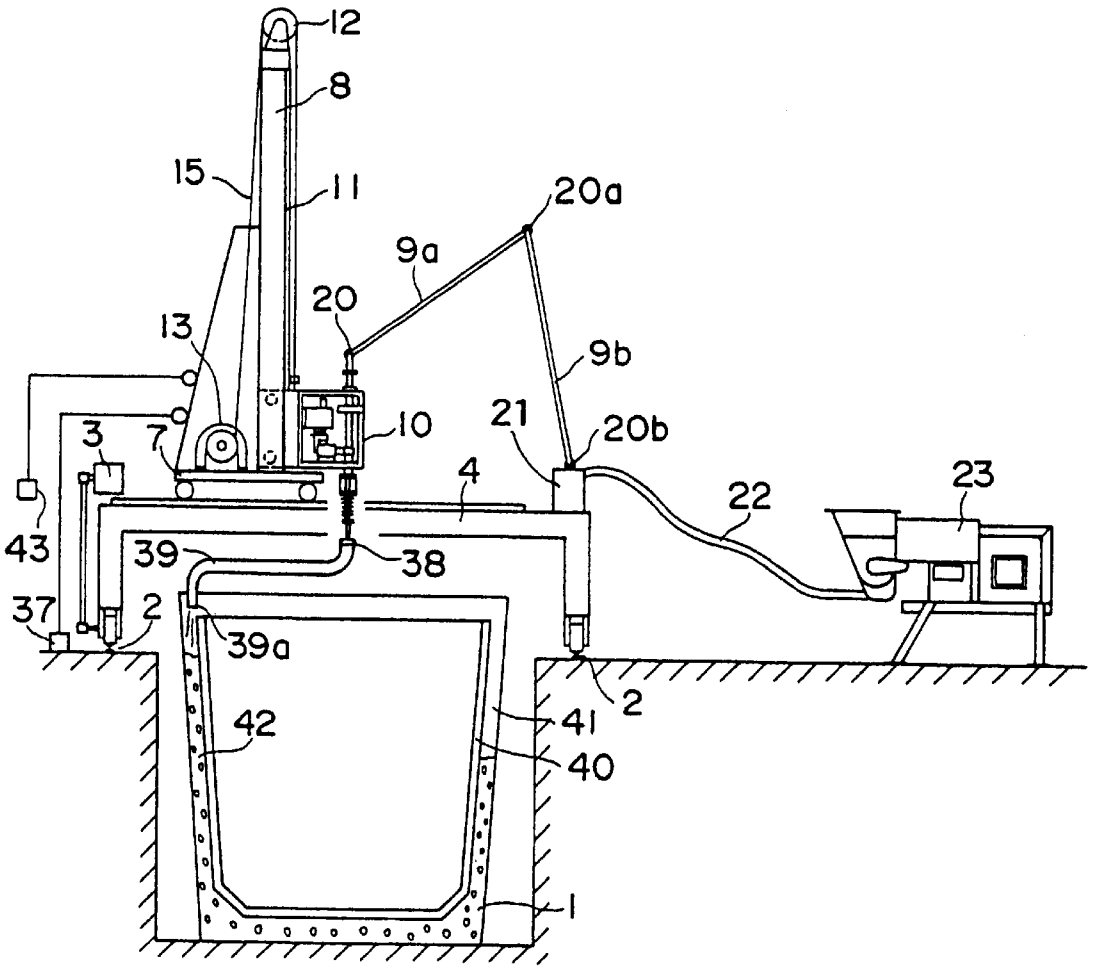
FIG. 5 is an elevation of a pouring pipe as set on the monolithic refractory depositing system shown in FIG. 1.

As shown in FIG. 4, a curved pipe 24 curved in one direction is joined to the lower end of a material feed pipe 9*c* projecting from the lower end of the elevating frame 10. A nozzle pipe 25 curved substantially at 90° has an upper end connected to the lower end 24*a* of the curved pipe 24 by a rotary joint 26. A spray nozzle 27 is connected to the free end of the nozzle pipe 25. When using a pouring pipe 39, the upper end of the material feed pipe 9*c* is disconnected from a joint 38 shown in FIGS. 3A and 3B, and the pouring pipe 39 is connected to the material feed pipe 9 by the joint 38 as shown in FIG. 5.

As shown in FIG. 3B, a jack 29 is disposed so as to face downward in a lower part of the elevating frame 10 shown in FIG. 3B swinging motor 28. the jack 29 is driven by a swinging motor 28. A rod included in the jack 29 is connected through a rotary joint 30 to a rod 31. When the jack 29 operates, thread of the jack 29 moves the rod 31 in vertical directions.

An arm 32 is fixed to an upper part of the nozzle pipe 25 as shown in FIG. 4. The lower end of the rod 31 is connected to the arm 32. The rod 31 is moved in vertical directions by the swinging motor 28 disposed in the lower part of the elevating frame 10. The swinging motor 28 drives the jack 29 to make the jack 29 tilt the nozzle pipe 25 through the rod 31.

An air hose 33 and a binder feed hose 34 are connected to a base part 27*a* of the spray nozzle 27. As shown in FIG. 2, the hoses 33 and 34 are extended through the elevating frame 10 and are connected to a compressed air source 35 and a binder feed pump 36, respectively.

The operation of the monolithic refractory depositing system in the first embodiment will be described below.

In the following description, it is assumed that the monolithic refractory depositing system is applied to spraying the ladle 1 with a material for repair.

When repairing the ladle 1 by spraying the ladle 1 with a material, the rails 2 are laid near the upper end of the ladle 1 as shown in FIGS. 1 and 2. The gantry-type carriage 4 is placed on the rails 2 so as to move in X-directions indicated in FIG. 1. The level of the carriage 4 is determined so that the movement of the carriage 4 over the ladle 1 may not be obstructed.

The traverse truck 7, the post 8 and the elevating frame 10 are mounted on the carriage 4. A power source 37 is connected to the monolithic refractory depositing system, the material feed hose 22, the air hole 33 and the binder feed hose 34 are connected to corresponding spruces, respectively. The spraying material is conveyed from the material supply device 23 through the material feed hose 22, the material feed pipes 9*b*, 9*a* and 9*c* to the spray nozzle 27. At the same time, air is supplied from the compressed air source 35 int the spray nozzle 27, and a binder is forced into the spray nozzle 27 by the binder feed pump 36.

Subsequently, a spraying operation is started. The material sprayed on the surface of a bed wall 1*a* of the ladle 1 in an initial stage of the spraying operation, and then the material is sprayed on the surface of a side wall 1*b* of the ladle 1 as shown in FIG. 2.

When spraying the material on the surface of the bed wall 1*a*, the jack 29 mounted on the elevating frame 10 is operated to direct the spray nozzle 27 downward, and then the electric winch 13 mounted on the elevating frame 10 is operated to adjust the distance between the extremity of the spray nozzle 27 and the surface of the bed wall 1*a* to an appropriate spraying distance.

The spraying distance is dependent on the construction of the spray nozzle. Usually, the spraying distance is in the range of about 200 to 800 mm. If the spraying distance does not match with the construction of the spray nozzle, the bed wall 1*a* will irregularly be filled or the bed wall 1*a* will not be finished in a smooth, flat surface, and hence the spraying operation will not satisfactorily be achieved.

During the spraying operation, the motor 3 drives the carriage 4 for longitudinal reciprocating movement in the X-directions, and the electric cylinder actuator 6 drives the traverse truck 7 for transverse reciprocating movement in Y-directions to spray the material over the entire surface of the bed wall 1*a*.

After the spraying operation for the bed wall 1*a* has been completed, the jack 29 is operated to direct the spray nozzle 27 toward the side wall 1*b*. The distance between the spray nozzle 27 and the surface of the side wall 1*b* is adjusted properly by moving the traverse truck 7 in the Y-directions. Then, the carriage 4 is moved while the elevating frame 10 is moved vertically to spray the surface of the side wall 1*b* with the spraying material.

The jack 29 is operated to direct the spray nozzle 27 sequentially toward a side wall 1*c* opposite the side wall 1*b*, and the side walls extending between the side walls 1*b* and 1*c* to spray the surfaces of all the side walls.

The operation of the monolithic refractory depositing system when the monolithic refractory depositing system is applied to repair the ladle 1 by pouring a casting material.

The rod 31 shown in FIG. 3A is removed, the material feed pipe 9*c* shown in FIG. 3A is disconnected from the joint 38, and the pouring pipe 39 is connected to the joint 38 as shown in FIG. 5.

The position of the elevating frame 10 is adjusted so as to corresponding substantially to the center of the ladle 1 by moving the carriage 4 in the X-directions by the motor 3 and moving the traverse truck 7 in the Y-directions (FIG. 1) by the electric cylinder actuator 6. The discharge opening 39*a* of the pouring pipe 39 is disposed opposite to a space 41 formed between a core 40 placed in the ladle 1 and the circumferential wall of the ladle 1. If the space 41 between the ladle 1 and the core 1 is round, the pouring pipe 39 is turned while the casting material is discharged through the discharge opening 39*a* into the space 41. If the space 41 between the ladle 1 and the core 40 is not round, the discharge opening 39*a* is located over the space 41 and the casting material 42 is discharged into the space 41 while the carriage 4 is moved in the x-directions by the motor 3 and the traverse truck 7 is moved in the Y-directions (FIG. 1) by the electric cylinder actuator 6.

The respective traveling speeds of the carriage 4 and the traverse truck 7, the moving speed of the elevating frame 10, the speed of turning of the material feed pipe 9 about a vertical axis, and the speed of swing motion of the spray nozzle 27 can be controlled according to spraying conditions by the inverter control of the drive motors.

The operation of the monolithic refractory depositing system may be controlled by an operator staying on the carriage 4 or by operating a remote control pendant switch device 43 (FIGS. 2 and 5) or a radio controller by an operator staying at a position suitable for visually monitoring spraying conditions.

A monolithic refractory depositing system in a second embodiment according to the present invention will be described hereinafter.

Figure 6:
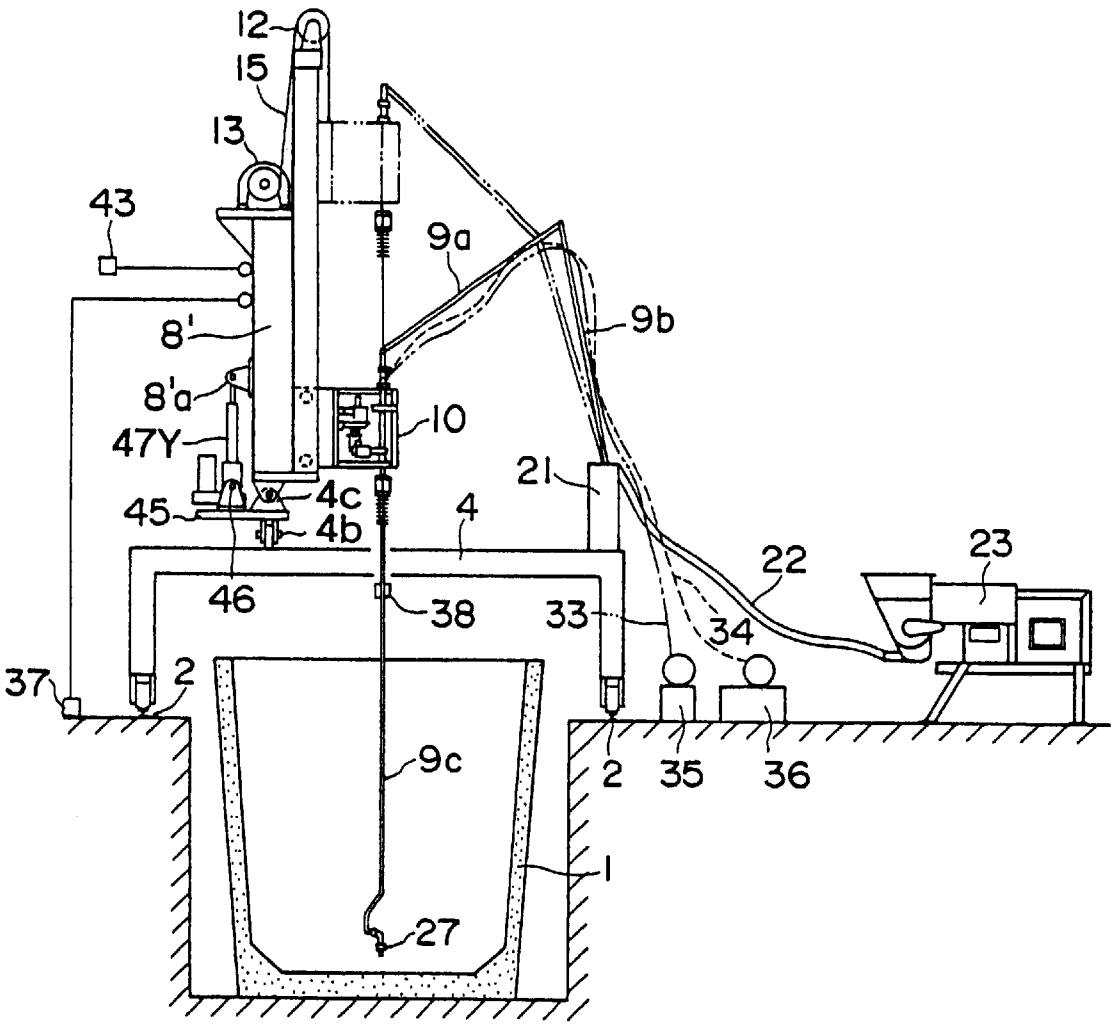
FIG. 6 is an elevation of a monolithic refractory depositing system in a second embodiment according to the present invention.
Figure 7:
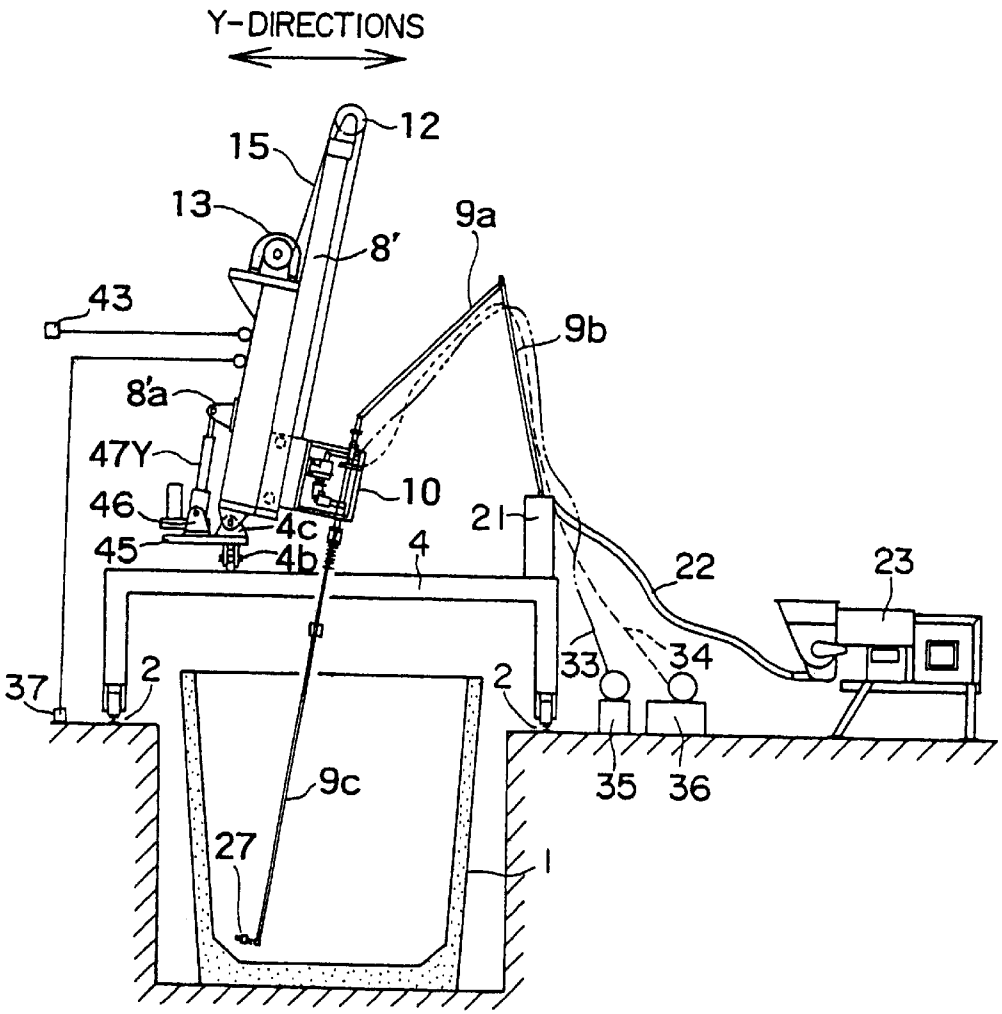
FIG. 7 is an elevation of a post shown in FIG. 6 tilted in a working position.

FIG. 6 is an elevation of the monolithic refractory depositing system in the second embodiment and FIG. 7 is an elevation showing the monolithic refractory depositing system in a tilted position during operation. The second embodiment shown in FIGS. 6 and 7 differs from the first embodiment shown in FIGS. 1 and 2 in that the second embodiment has a tiltable truck 45 instead of the traverse truck 7 employed in the first embodiment. Since most parts of the second embodiment excluding those around the tiltable truck 45 are similar to the corresponding parts of the first embodiment shown in FIGS. 1 and 2. Therefore parts shown in FIGS. 6 and 7 like or corresponding to those shown in FIGS. 1 and 2 are designated by the same reference characters and the description thereof will be omitted and only the parts different from those of the first embodiment will be described.

As shown in FIG. 6, the tiltable truck 45 is pivotally joined with a pin to a bearing 4*b* held on a carriage 4 so as to be tiltable in the traveling directions of the carriage 4.

A post 8' is set upright on the tiltable truck 45 and is pivotally joined with a pin to a bearing 4*c* fixed to the upper surface of the tiltable truck 45 so as to be tiltable in directions perpendicular to the traveling directions of the carriage 4. An electric cylinder actuator 47Y has a base end part pivotally joined with a pin to a bearing 46 fixed to the upper surface of the tiltable truck 45. The free end of a rod included in the electric cylinder actuator 47Y is pivotally joined with a pin to a bearing 8'*a* fixed to a middle part of the post 8'.

The rod of the electric cylinder actuator 47Y is stretched out to tilt the post 8' in a direction perpendicular to the traveling directions of the carriage 4. the rod of another electric cylinder actuator 47X, not shown, disposed on the carriage 4 is stretched out to tilt the post 8' in a direction parallel to the traveling directions of the carriage 4.

Thus, the post silted in the X- and the Y-directions (FIG. 1), a spray nozzle or the pouring pipe 39 can be moved, similarly to the spray nozzle 27 and the pouring pipe 39 shown in FIGS. 1 and 5, in directions parallel to the X- and the Y-directions.

FIG. 7 shows the post 8' tilted in a desired direction to move the spray nozzle 27 to a desired spraying position.

A monolithic refractory structure constructing system in a third embodiment according to the present invention will be described hereinafter.

Figure 8:
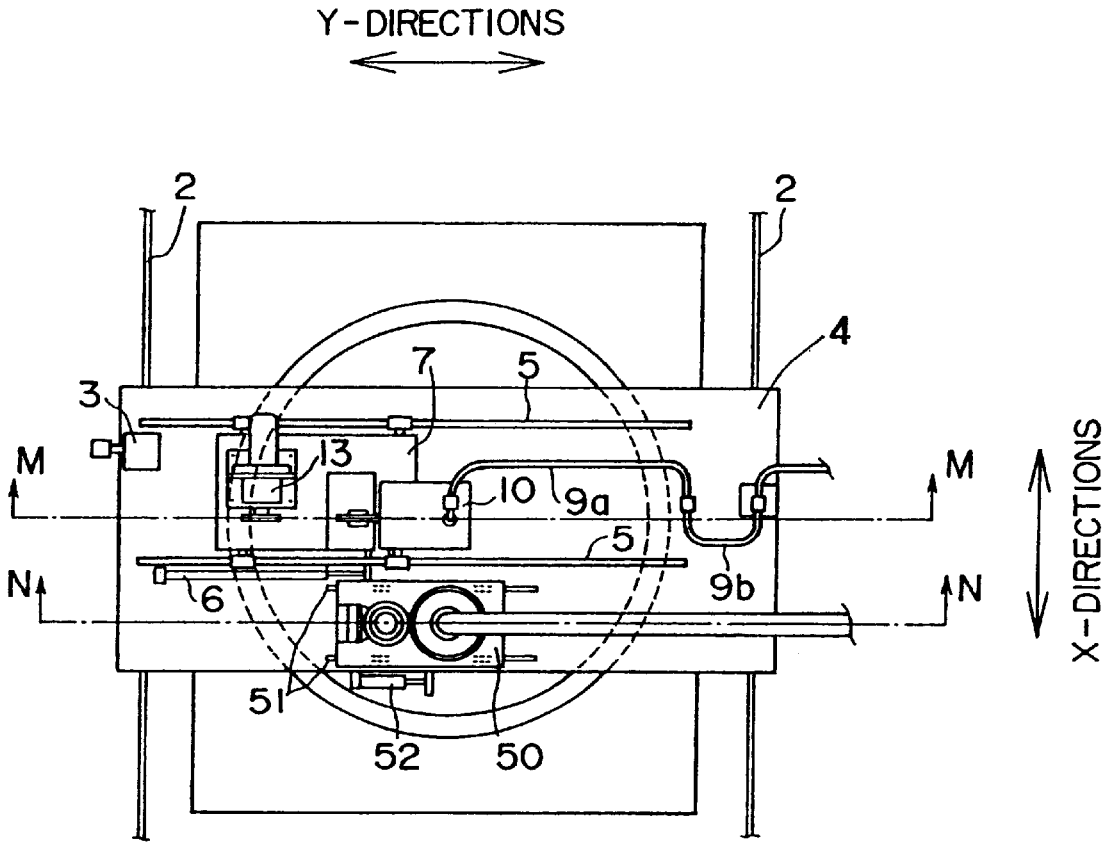
FIG. 8 is a plan view of a monolithic refractory depositing system in a third embodiment according to the present invention.
Figure 9:
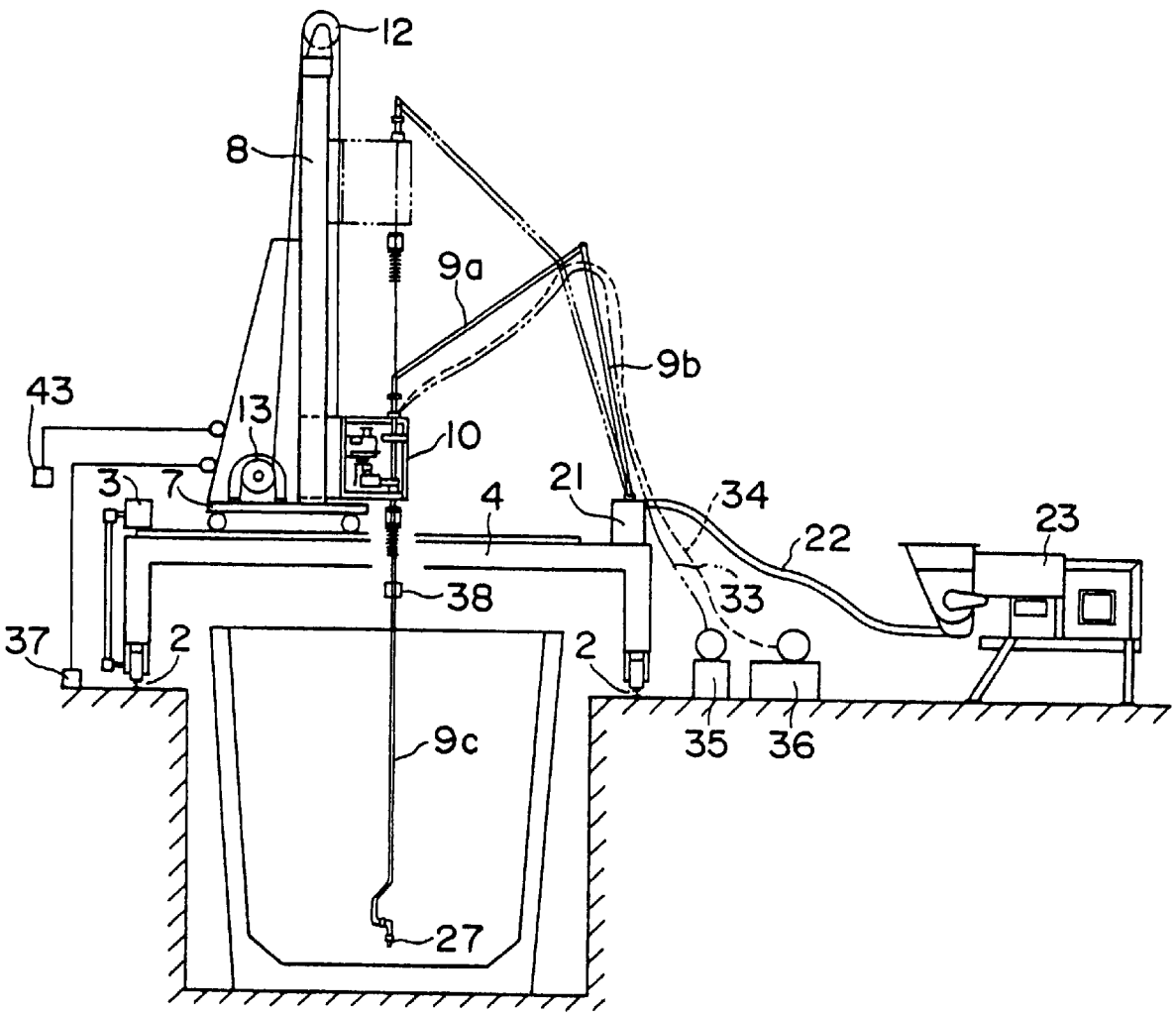
FIG. 9 is a sectional elevation taken on line M-M in FIG.

FIG. 8 is a plan view of the monolithic refractory structure constructing system in the third embodiment and FIG. 9 is a sectional view taken on line M—M in FIG. 8.

The third embodiment is provided, in addition to the components of the monolithic refractory structure constructing system shown in FIG. 1, 2 or 5, with a pouring traverse truck 50. Only the additional components of the third embodiment not included in the monolithic refractory structure constructing system shown in FIGS. 1, 2 and 5 will be described to avoid duplication.

Referring to FIG. 8, a traverse truck 7 is mounted on a carriage 4 for movement in Y-directions perpendicular to X-directions, i.e., the moving directions of the carriage 4, and the pouring traverse truck 50 is mounted on the carriage 4 for movement in parallel to the moving directions of the traverse truck 7.

Figure 11:
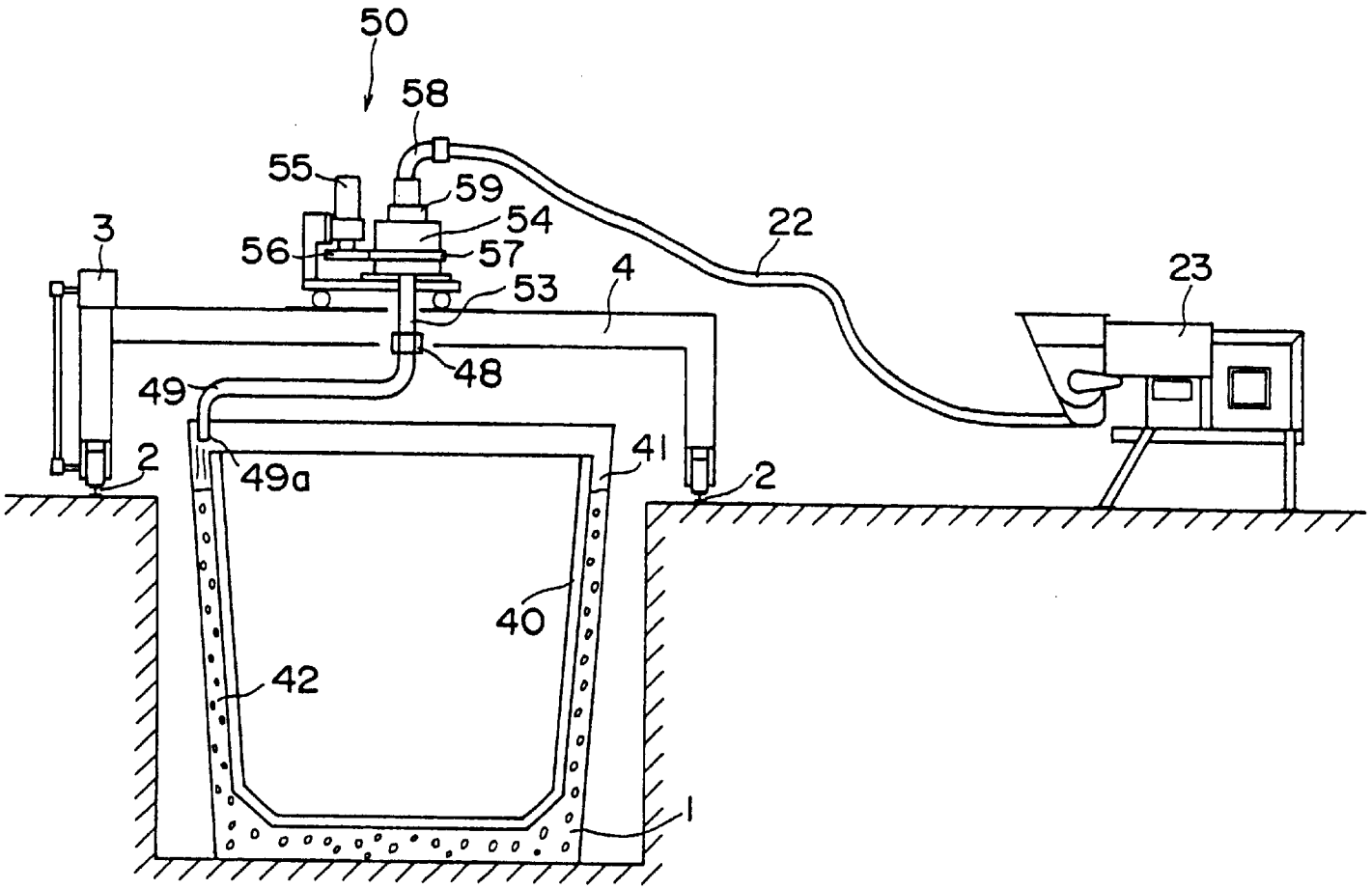
FIG. 11 is an elevation taken on line N—N in FIG. 10.

FIG. 11 is a sectional view taken on line N—N in FIG. 8, in which the pouring traverse truck 50 in a refractory material pouring operation is shown in an elevation.

Rails 51 are laid on the carriage 4 in parallel to guide rails 5 for guiding the traverse truck 7, and the pouring traverse truck 50 is moved along the rails 51 by an electric cylinder actuator 52.

Referring to FIG. 11, a casing 54 is mounted on the pouring traverse truck 50, and a second material feed pipe 53 is extended through and supported for turning on the casing 54. The second material feed pipe 53, and the material feed pipes 9, 9*a* and 9*b* are used for separate purposes, respectively. A motor 55 for driving the second material feed pipe 53 for turning is mounted on the pouring traverse truck 50. A gear 57 mounted on the material feed pipe 53 and a pinion 56 mounted on the output shaft of the motor 55 are engaged to drive the second material feed pipe 53 for turning about a vertical axis.

A 90° elbow 58 has one end connected through a sliding joint 59 to an upper part of the casing 54, and the other end connected to a material feed hose 22 connected to a material supply device 23.

A second pouring pipe 49 is fixedly joined to the lower end of a part of the second material feed pipe 53 projecting downward from the casing 54 by a joint 48.

Repairing operation for repairing a ladle 1 by using a casting material will be described below.

Figure 10:
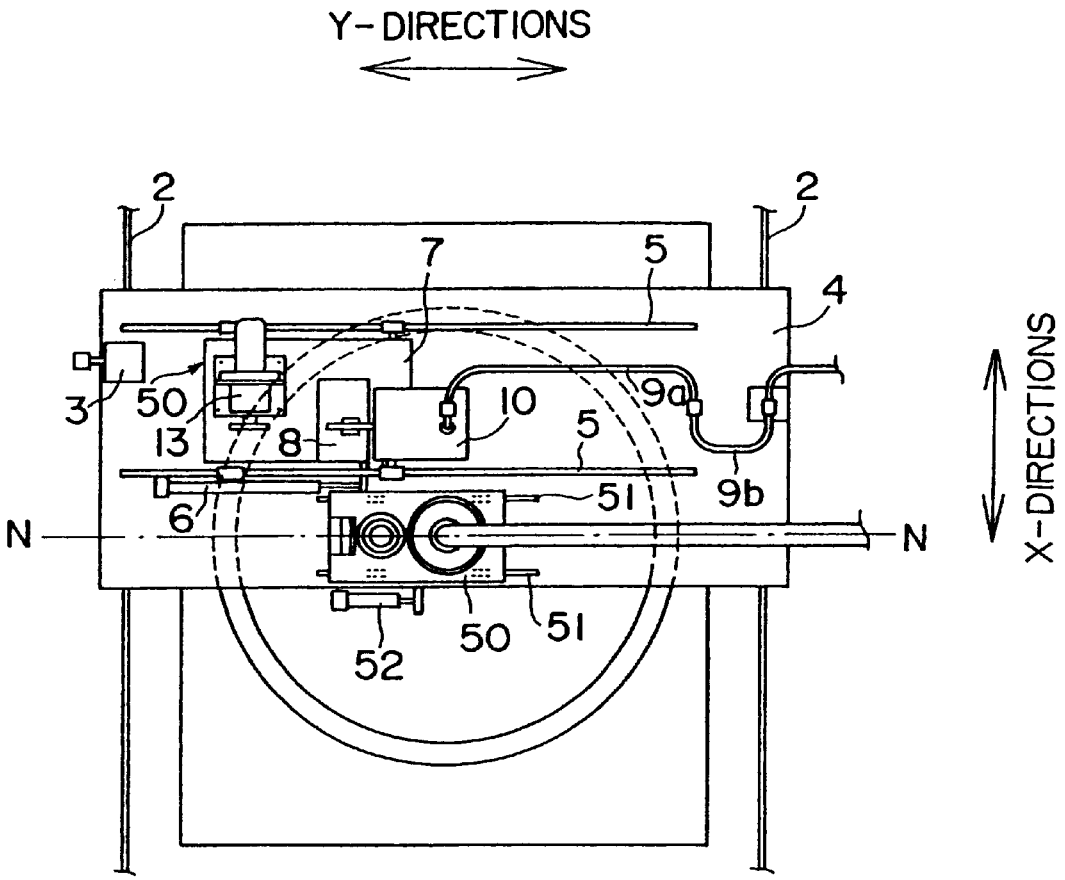
FIG. 10 is a plan view, similar to FIG. 8, of the monolithic refractory depositing system in a state different from that shown in FIG. 8.

Referring to FIGS. 10 and 11, rails 2 are laid near the upper end of the ladle 1, the gantry-type carriage 4 is placed on the rails 2 so as to span the ladle 1, and the pouring traverse truck 50 is mounted on the carriage 4 so as to move in directions perpendicular to the traveling directions of the carriage 4.

The elbow 58 is connected through the sliding joint 59 to the upper part of the casing 54 mounted on the pouring traverse truck 50, and the elbow 58 is connected to the material supply device 23 by the material feed hose 22.

The second pouring pipe 49 is fixedly joined to the lower end of a part of the second material feed pipe 53 projecting downward from the casing 54 by a joint 48.

The carriage 4 is moved over the ladle 1 by a motor 3 to locate the same at a position corresponding to the center of the ladle 1. Then, the pouring traverse truck 50 is moved in a transverse direction by the electric cylinder actuator 52 to locate the casing 54 at a position substantially corresponding to the center of the ladle 1 to locate the discharge opening 49*a* of the second pouring pipe 49 opposite to a space formed between the circumferential wall of the ladle 1 and a core 40 placed i the ladle 1.

After a predetermined quantity of the casting material 42 has been poured into the space 41, the carriage 4 and the pouring traverse truck 50 move the second pouring pipe 49 to the next pouring position. The motor 55 is actuated to drive the second material feed pipe 53 for turning through the pinion 56 of the motor 55, the gear 57 engaged with the pinion 56 and mounted on the second material feed pipe 53 so that the discharge opening 49*a* of the second pouring pipe 49 is moved to the next pouring position. Then, a predetermined quantity of the casting material is poured into the space 41. This cycle of operation is repeated to fill up the space 41 between the ladle 1 and the core 40 with the casting material.

If the space 41 formed between the ladle 1 and the core 40 is round, the second pouring pipe 49 is formed in a length equal to half the diameter of the round space 41, the positions of the carriage 4 and the pouring traverse truck 50 are adjusted so as to locate the casing 54 fixedly at a position above the ladle 1 and corresponding to the center of the ladle 1, and then the second material feed pipe 58 is turned to fill up the space 41 between the ladle 1 and the core 40 with the casting material 42.

The third embodiment additionally provided with the casting traverse truck 50, the second material feed pipe 53 only for casting and the second pouring pipe 49 exercises the following effects.

Different pouring materials can be used by using the pouring pipe 39 connected to the joint 38 as shown in FIG. 5, and the second pouring pipe 49. Therefore, the third embodiment is able to repair parts requiring different kinds of repair work properly by pouring the different casting materials selectively to those parts. When the material feed pipe 9*c* connected to the spray nozzle 27 is connected to the joint 38 as shown in FIG. 9, spraying work can be performed by using the spray nozzle 27 immediately after completing repairing work for repairing parts requiring repair by casting the material by the second pouring pipe 49.

A monolithic refractory structure constructing system in a fourth embodiment according to the present invention will be described hereinafter.

Figure 13:
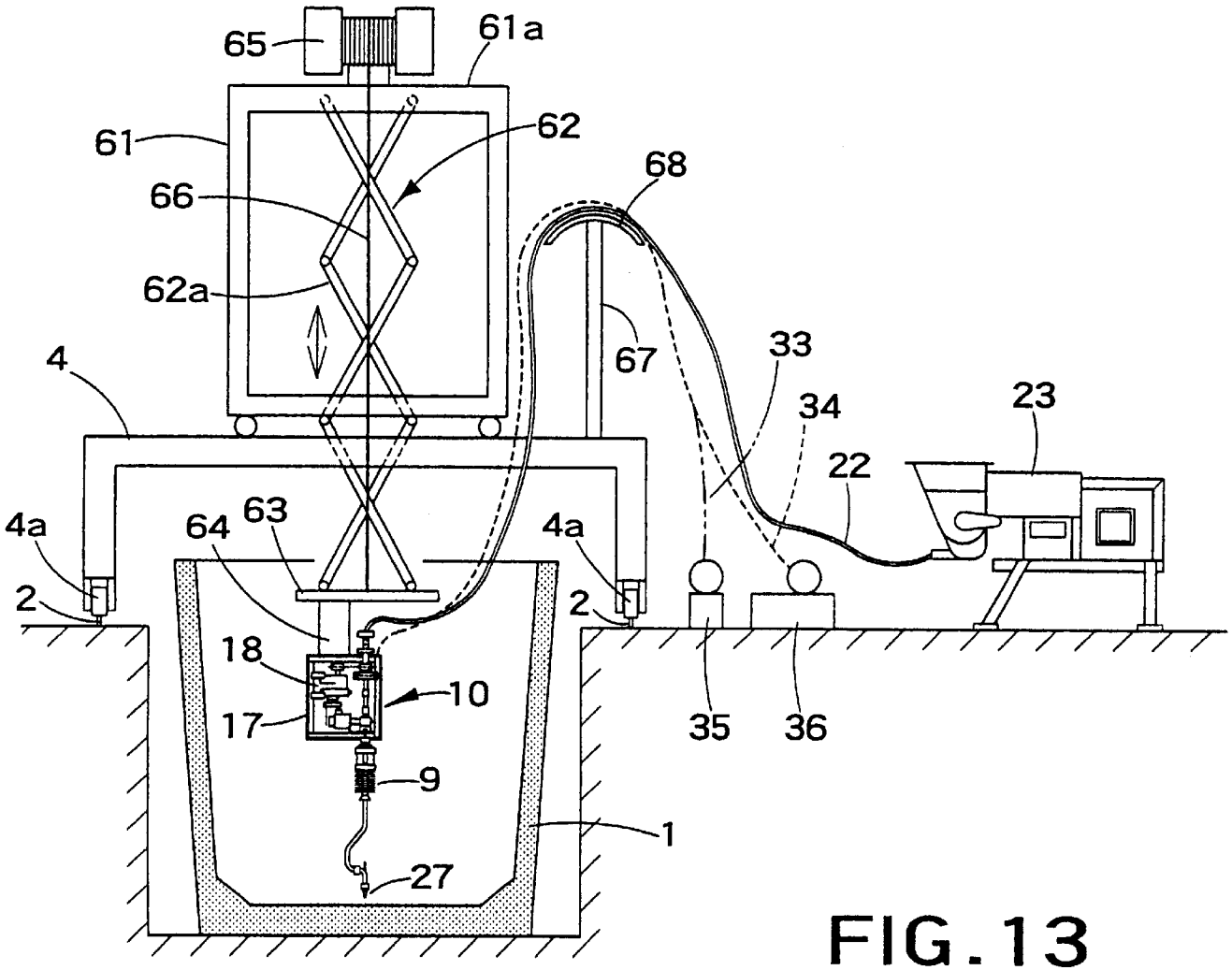
FIG. 13 is an elevation of a monolithic refractory depositing system in a fourth embodiment according to the present invention.

FIG. 13 shows an elevating mechanism for vertically moving the elevating frame 10. When the elevating frame 10 is moved vertically along the post 8 set up on the traverse truck 7 as mentioned in the description of the foregoing embodiments, the overall height of the monolithic refractory structure constructing system is inevitably great and the traverse truck 7 supporting the post 8 must be large, which affects adversely to the cost and the installation space required by the monolithic refractory structure constructing system and, since the material feed pipe 9 is long, the material feed pipe 9 requires difficult work for replacing the same with another one when the same is clogged with the material. The fourth embodiment is designed, in view of those problems, to construct a monolithic refractory structure constructing system in a reduced height, to use a small traverse truck and to reduce the length of the material feed pipe 9.

The monolithic refractory structure constructing system in the fourth embodiment is provided with a frame truck 61 having the shape of a vertically elongate, rectangular frame and serving as a traverse truck. A elevating frame 10 is suspended from the frame truck 61 by an extendible mechanism 62 so as to be moved vertically. A pantograph type linkage 62*a* is used as the extendible mechanism 62. The pantograph type linkage 62*a* is formed by pivotally joining a plurality of unit sections each formed by pivotally joining together the respective middle parts of two links. The upper end of the pantograph type linkage 62*a* is connected to an upper frame 61*a* of the frame truck 61. A base plate 63 is attached to the lower end of the pantograph type linkage 62*a*. An elevating frame 10 similar to that employed in the foregoing embodiments is held by a holding member 64 fixedly attached to the lower surface of the base plate 63. A material feed pipe 9 has an upper end connected so as to be turnable to the elevating frame 10.

A winch 65 for hoisting is mounted on the upper frame 61*a* of the frame truck 61. The lower end of a wire 66 child on a drum included in the winch 65 is attached to the base plate 63. The winch 65 winds and unwinds the cable to elevate and lower the base plate 63 holding the elevating frame 10 so as to contract and extend the pantograph type linkage 62*a*.

A material feed hose 22 has one end connected to the upper end of the material feed pipe 9 and the other end connected to a material supply device 23. The material feed hose 22 is supported on an upward convex hose guide 68 supported on a post 67 set up on the carriage 4. An air hose 33 and a binder feed holes 34 extended from corresponding supply devices via the hose guide 68 to the elevating frame 10.

The monolithic refractory depositing system in the fourth embodiment is similar in other respects to the monolithic refractory depositing systems in the foregoing embodiments. Components of the monolithic refractory depositing system in the fourth embodiment like or corresponding to those of the monolithic refractory depositing systems in the foregoing embodiments are designated and the description thereof will be omitted.

In the fourth embodiment, the material feed pipe 9 may be very short because the elevating frame 10 is moved vertically under the carriage 4. Consequently, the possibility of the material feed pipe 9 being clogged with the material is reduced and, even if the material feed pipe 9 should be clogged with the material, the material feed pipe 9 can easily be replaced with another one. In the fourth embodiment, any post need not be set up on the traverse truck, and the monolithic refractory depositing system can be formed in a compact structure not requiring a large space for installation.

The nozzle can properly be positioned by operating the winch 65 during a spraying or casting operation.

A monolithic refractory depositing system in a fifth embodiment according to the present invention will be described with reference to FIG. 14.

Figure 14:
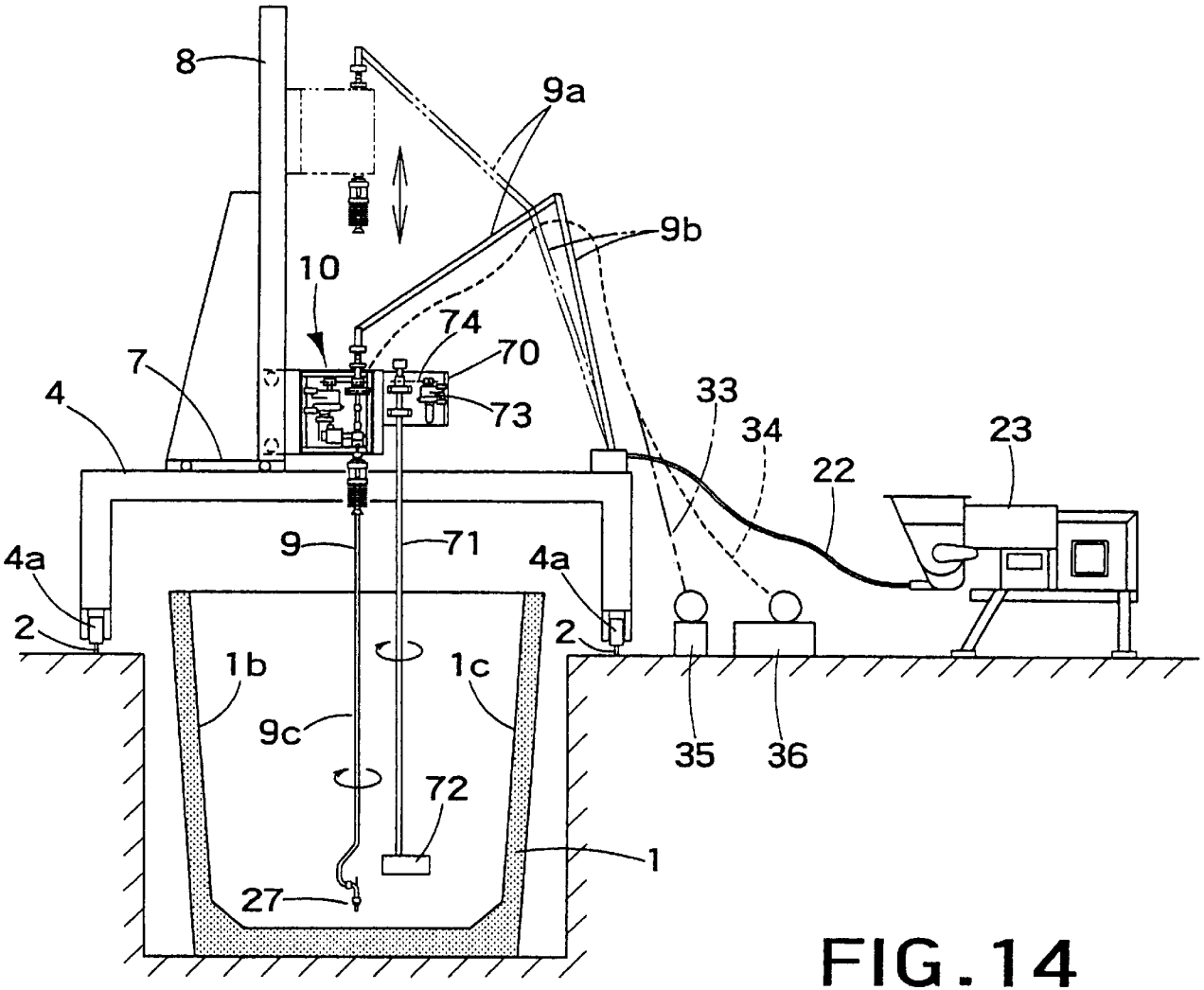
FIG. 14 is an elevation of a monolithic refractory depositing system in a fifth embodiment according to the present invention.

The monolithic refractory depositing system shown in FIG. 14 is capable of depositing a material exactly in a desired thickness for repair by spraying so that a lining may not be formed in an insufficient thickness and an excessive amount of the material may not be deposited by spraying.

Basically, the monolithic refractory depositing system shown in FIG. 14 is similar in construction to that previously described with reference to FIGS. 1 to 4. In FIG. 14, some components are omitted. As shown in FIG. 14, a rotating mechanism 70 provided with a support pipe 71 is mounted on an elevating frame 10, and a thickness measuring device 72 is attached to the lower end of the support pipe 71.

The turning mechanism 70 is similar to the turning mechanism for turning the material feed pipe 9. A chain 74 is extended between a sprocket mounted on the output shaft of a motor 73 and a sprocket mounted on a support pipe 71, and the motor 73 drives the support pipe 71 for turning through an angle of 360°. The thickness measuring device 72 can vertically be moved by an elevating mechanism, not shown, to a level below that of the level of a spray nozzle 27 to enable the thickness measuring device 72 to execute measurement without being obstructed by the spray nozzle 27.

The thickness measuring device 72 is a laser thickness meter or an ultrasonic thickness meter commercially available from, for example, Kabushiki Kaisha Kiiensu. Data on the profile of a lining is given previously to an arithmetic unit, the difference between the actual thickness of the lining and the from a desired thickness is calculated on the basis of a measured distance and a position data provided by an NC device, and measured results are displayed.

When repairing the lining, A part to be repaired can be finished in a predetermined thickness by controlling the moving speed of the spray nozzle 27 by the NC device if the thickness of the part to be repaired is measured before starting a spraying operation.

The monolithic refractory depositing system shown in FIG. 14 is similar in other respects as the monolithic refractory depositing system shown in FIG. 2. In FIG. 14 components like or corresponding to those of the monolithic refractory depositing system shown in FIG. 2 are designated by the same reference characters and the description thereof will be omitted.

The fifth embodiment is capable of depositing a material exactly in a desired thickness by spraying so that the lining may not be formed in an insufficient thickness and an excessive amount of the material may not be deposited, which prevents troubles during operation and reduces the costs.

A method of automatically controlling a monolithic refractory depositing system according to the present invention will be described below.

Figure 12:
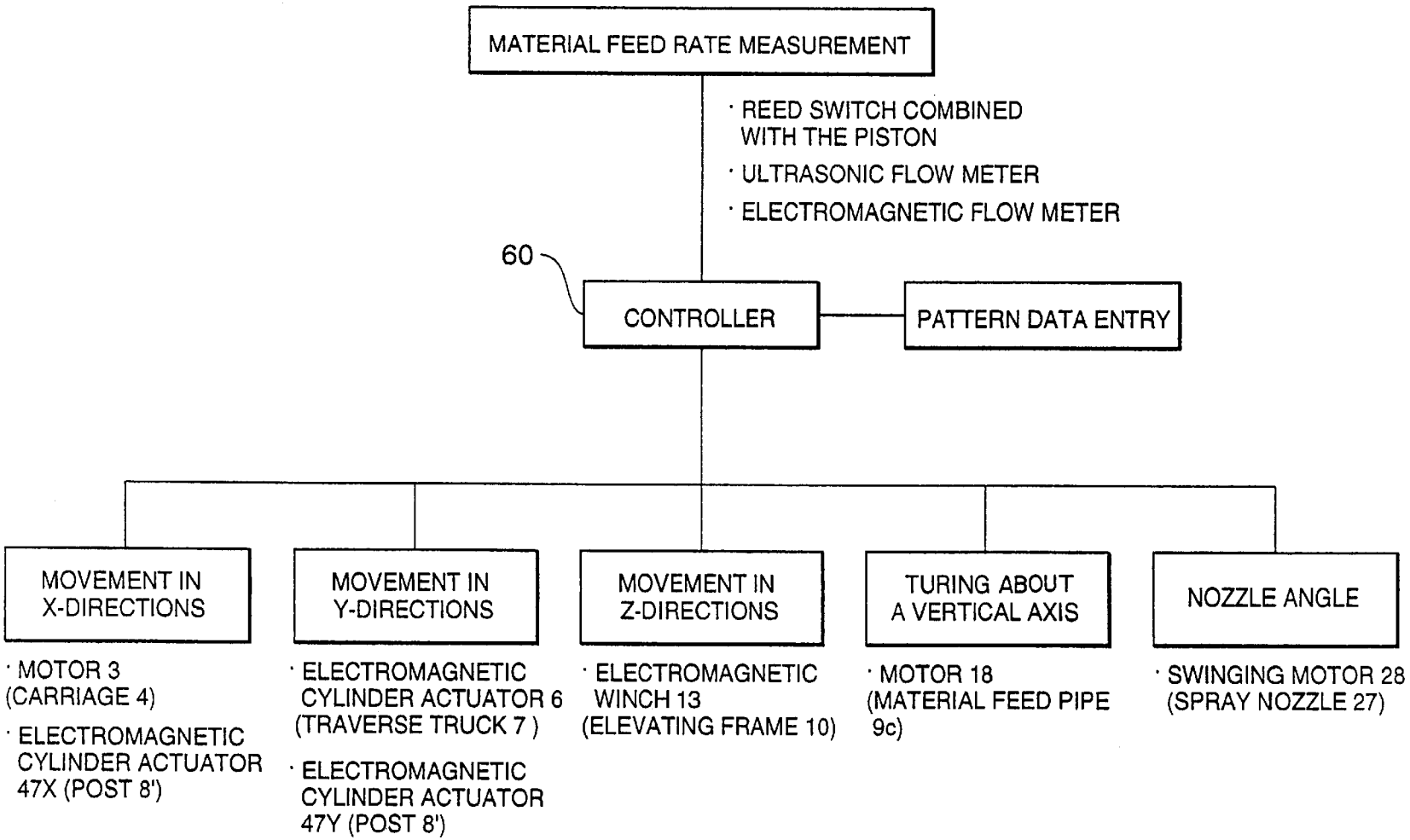
FIG. 12 is a block diagram of assistance in explaining a method of automatically controlling a monolithic refractory depositing system according to the present invention.

FIG. 12 is a block diagram of assistance in explaining a method of automatically controlling a monolithic refractory depositing system according to the present invention. The material supply rate of a material supply device 23 and the moving speed of a spray nozzle are controlled in an automatic control mode to finish a part of a lining to be repaired in a fixed thickness (usually, a thickness on the order of 200 mm). A program representing a pattern specifying nozzle moving speed and moving order is loaded into a controller 60 before starring a spraying operation. In most cases, the material supply device 23 is provided with a piston pump. It is difficult to control the material supply device 23 so that the flow of the material may not be pulsated due to the pulsative characteristic of the piston pump.

Instantaneous material discharge rate is measured by a measuring device, such as a reed switch combined with a piston, or an ultrasonic flow meter or an electromagnetic flow meter combined with a material feed pipe. The movement of a material feed pipe in X, Y and Z directions, the turning of the material feed pipe about a vertical axis, and the angle of a spray nozzle are regulated automatically according to a measured instantaneous discharge rate. Servomotors capable of accurate position determination and speed regulation are used as driving means for automatic regulation.

Although not shown in FIG. 12, a flow meter for measuring the amount of the material pumped by a spraying material pump and a detector for detecting an additive are electrically connected to the controller 60 for measuring material feed rate. As mentioned above, the program representing a pattern specifying nozzle moving speed and moving order is loaded into the controller 60. A carriage 4 is driven for movement by a motor 3 or a post 8 is driven for tilting by an electric cylinder actuator 47X to move the spray nozzle in the X-direction. A transverse truck 7 is driven for transverse movement by an electric cylinder actuator 6 or a post 8' is driven for tilting by an electric cylinder actuator 47Y disposed with its axis extended perpendicularly to that of the electric cylinder actuator 47X to move the spray nozzle in the Y-direction. An elevating frame 10 is moved vertically by the electric winch 13 to move the spray nozzle in the Z-direction.

A material feed pipe 9*c* is turned about its vertical axis by a motor 18. The spraying angle of the spray nozzle 27 is adjusted by driving the spray nozzle 27 for turning by a swinging motor 28.

As is apparent from the foregoing description, the present invention has the following effects.

1) When repairing a molten metal container, such as a ladle, the spray nozzle attached to the heavy pipe need not be held by hand, and the spray nozzle can be driven for traveling, transverse movement, vertical movement and turning by the devices to spray all the surfaces of the molten metal container with a material at proper spraying angles. Thus, stable spraying work can be achieved by only one operator and labor cost can be reduced.

2) The monolithic refractory depositing system can selectively be used for spraying work or casting work by selectively using a spraying pipe or a pouring pipe, work for changing the construction apparatuses according to the required work is not necessary and, therefore, the efficiency of work can greatly be improved. Since only one system is necessary, equipment cost is reduced and space for installation can be reduced.

3) Since the spray nozzle can be driven for traveling, transverse movement, vertical movement and turning by the devices to spray all the surfaces of the molten metal container with a material at proper spraying angles, the facility of work is improved.

4) Since the construction apparatus is provided with both the mechanisms for spraying and casting, the spraying pipe and the pouring pipe need not be replaced with each other, so that the efficiency of work is further improved.

5) Since the swivel pipe joints are employed as the bendable support means, the spraying material is able to flow smoothly through the material feed pipes even if the material feed pipes are moved vertically as the elevating frame is moved.

6) The spraying work can automatically be controlled, and the construction apparatus can be controlled in a remote control mode from a position apart from the site and hence the operator is freed from heavy manual work.

7) Since the material feed pipe 9 is very short because the elevating frame 10 is moved under the carriage 4, the possibility of the material feed pipe 9 being clogged with the material is reduced and, even if the material feed pipe 9 should be clogged with the material, the material feed pipe 9 can easily be replaced with another one. Since any post need not be set up on the traverse truck, the monolithic refractory depositing system can be formed in a compact structure and the traverse truck may be small and the monolithic refractory depositing system needs a small space for installation.

8) Since the thickness measuring device 72 is attached to the lower end of the support pipe 71, the material can be deposited exactly in a desired thickness by spraying so that the lining may not be formed in an insufficient thickness and an excessive amount of the material may not be deposited, which prevents troubles during operation and reduces the costs.

What is claimed is:

1. A monolithic refractory depositing system comprising:

a carriage placed on rails laid near a molten metal container so as to travel over the molten metal container along the rails;

a truck mounted on the carriage so as to move in directions perpendicular to the moving directions of the carriage;

an elevating frame mounted for vertical movement on the truck;

a material feed pipe attached to the elevating frame;

a spray nozzle of pouring pipe to be detachably connected to a lower end of the material feed pipe, and wherein a post tiltable relative to the carriage is provided on the truck.

2. The monolithic refractory depositing system according to claim 1, wherein the truck is a traverse truck mounted on the carriage so as to move in directions perpendicular to the moving directions of the carriage.

3. The monolithic refractory depositing system according to claim 1, wherein a post is set up on the truck, and the elevating frame is supported for vertical movement on the post.

4. The monolithic refractory depositing system according to claim 1, wherein a bendable support means capable of moving together with the elevating frame is connected to a part of the feed pipe on an upper side of the elevating frame.

5. The monolithic refractory depositing system according to claim 4, the bendable support means may comprise pipes and a rotary joint joining the pipes together for turning relative to each other.

6. The monolithic refractory depositing system according to claim 1 further comprising a controller for the automatic control of spraying rate at which a material is sprayed, thickness in which the material is deposited and a spraying process according to the shape and size of the molten metal container.

7. The monolithic refractory depositing system according to claim 1 further comprising: a support rod capable of turning and vertically moving along the material feed pipe and disposed in a vertical position, and a thickness measuring device held on a lower end part of the support rod to measure the thickness of a part of a structure being formed.

8. The monolithic refractory depositing system according to claim 1, wherein the material feed pipe is inserted in an upper part of the elevating frame so as to project from a lower part of the elevating frame and supported on the elevating frame.

9. The monolithic refractory depositing system according to claim 1 further comprising an extendible mechanism attached to an upper part of the truck to move the elevating frame vertically.

10. The monolithic refractory depositing system according to claim 9, wherein the extendible mechanism is attached to the truck so as to extend downward from an upper part of the truck.

11. The monolithic refractory depositing system according to claim 9, wherein the extendible mechanism is a linkage of a pantograph type.

12. The monolithic refractory depositing system according to claim 1, wherein the material feed pipe is connected to a material feed hose for feeding a material.

13. The monolithic refractory depositing system according to claim 12, wherein the material feed hose is supported on a hose guide.

14. The monolithic refractory depositing system according to claim 1, wherein the pouring pipe is turnable about a vertical axis.

15. A monolithic refractory depositing system comprising:

a carriage placed on rails laid near a molten metal container so as to travel over the molten metal container along the rails;

a truck mounted on the carriage so as to move in directions perpendicular to the moving directions of the carriage;

an elevating frame mounted for vertical movement on the truck;

a material feed pipe attached to the elevating frame;

a spray nozzle or a pouring pipe to be detachably connected to a lower end of the material feed pipe, and further comprising:

a pouring traverse truck disposed beside the truck and capable of moving in directions perpendicular to the moving directions of the carriage;

a second material feed pipe connected to an upper part of the pouring traverse truck; and a second pouring pipe disposed on a lower part of the pouring traverse truck so as to be turnable in a horizontal plane.

* * * * *